US009902517B2

(12) United States Patent
Bierschenk et al.

(10) Patent No.: US 9,902,517 B2
(45) Date of Patent: Feb. 27, 2018

(54) APPARATUS AND METHOD FOR A STRUCTURALLY RESILIENT PACKAGE

(71) Applicants: Frito-Lay North America, Inc., Plano, TX (US); Douglas Machine Inc., Alexandria, MN (US)

(72) Inventors: Parick Joseph Bierschenk, Dallas, TX (US); Frank Mathew Brenkus, McKinney, TX (US); Ronald M. Gust, Miltona, MN (US); Leon J. Krause, Miltona, MN (US); Sunitha Nair, Dallas, TX (US)

(73) Assignees: Frito-Lay North America, Inc., Plano, TX (US); Douglas Machine Inc., Alexandria, MN (US)

( * ) Notice: Subject to any disclaimer, the term of this patent is extended or adjusted under 35 U.S.C. 154(b) by 623 days.

(21) Appl. No.: 14/528,726

(22) Filed: Oct. 30, 2014

(65) Prior Publication Data

US 2015/0121811 A1 May 7, 2015

Related U.S. Application Data

(60) Provisional application No. 61/898,593, filed on Nov. 1, 2013, provisional application No. 61/898,626, filed
(Continued)

(51) Int. Cl.
*B65B 61/24* (2006.01)
*B65B 61/28* (2006.01)
(Continued)

(52) U.S. Cl.
CPC ..... *B65B 61/24* (2013.01); *B65B 51/32* (2013.01); *B65D 75/008* (2013.01); *B65D 75/5838* (2013.01); *B65B 61/28* (2013.01)

(58) Field of Classification Search
CPC ..... B65B 7/08; B65B 51/32; B65B 61/24; B65B 61/28; B65B 9/2042; B65B 9/2049;
(Continued)

(56) References Cited

U.S. PATENT DOCUMENTS 1,998,287 A * 4/1935 Pierson et al. ..... B65B 7/08 493/243
3,263,391 A 8/1966 Wallsten
(Continued)

FOREIGN PATENT DOCUMENTS

DE 2514120 A1 10/1976
DE 2703455 A1 10/1977
(Continued)

OTHER PUBLICATIONS

PCT International Search Report for application No. PCT/US2014/063415 dated Feb. 17, 2015, 3 pages.

*Primary Examiner* — Stephen F Gerrity
(74) *Attorney, Agent, or Firm* — Krista Y. Chan; Colin P. Cahoon; Carstens & Cahoon, LLP

(57) ABSTRACT

A method and apparatus for making a structurally resilient package having a substantially box-shaped configuration is disclosed. A pillow pouch package is received onto a flighted conveyor. The pillow pouch package has a first squared end and an angular end located opposite to the first squared end. The pillow pouch package is received so that the first squared end rests on the flighted conveyor. Thereafter the pillow pouch package is conditioned at least in part by tamping the angular end with a tamping plate. The angular end of the package is subsequently heat treated to form a second squared end. A set of cooling plates is then applied to the second squared end to set the final shape and form the structurally resilient package having a substantially box-shaped configuration.

22 Claims, 6 Drawing Sheets

Related U.S. Application Data on Nov. 1, 2013, provisional application No. 62/072,106, filed on Oct. 29, 2014.

(51) Int. Cl.
*B65B 51/32* (2006.01)
*B65D 75/00* (2006.01)
*B65D 75/58* (2006.01)

(58) Field of Classification Search
CPC ... B65B 9/2056; B65B 9/213; B65B 2220/24; B29C 66/032; B29C 66/03241; B29C 66/0342
USPC ..... 53/436, 437, 451, 525, 526, 551, 370.2, 53/370.6, 371.7, 371.8, 372.2, 372.3, 53/372.5, 372.7, 374.7, 375.3, 375.5, 53/375.7, 387.1–387.4
See application file for complete search history.

(56) References Cited

U.S. PATENT DOCUMENTS

| | | | | |
|---|---|---|---|---|
| 3,347,015 | A | 10/1967 | Nutting et al. | |
| 3,738,080 | A | 6/1973 | Reil | |
| 3,857,223 | A | 12/1974 | Dominici | |
| 4,034,537 | A | 7/1977 | Reil et al. | |
| 4,079,572 | A | 3/1978 | Vande Castle | |
| 4,079,662 | A | 3/1978 | Puccetti et al. | |
| 4,080,237 | A * | 3/1978 | Deimel | B65B 51/20 156/226 |
| 4,129,976 | A | 12/1978 | Grundler | |
| 4,387,547 | A * | 6/1983 | Reil | B65B 9/2014 53/131.5 |
| 4,446,676 | A * | 5/1984 | Grundler | B65B 61/28 493/194 |
| 4,462,202 | A * | 7/1984 | Reil | B65B 61/24 198/803.9 |
| 4,485,613 | A | 12/1984 | Saur | |
| 4,614,079 | A * | 9/1986 | Ida et al. | B65B 3/02 53/372.3 |
| 5,398,486 | A * | 3/1995 | Kauss et al. | B65B 9/2042 493/189 |
| 5,447,014 | A * | 9/1995 | Adams et al. | B65B 19/226 53/148 |
| 5,473,866 | A * | 12/1995 | Maglecic et al. | B65B 1/22 53/151 |
| 5,505,040 | A | 4/1996 | Janssen et al. | |
| 5,832,701 | A | 11/1998 | Hauers et al. | |
| 5,836,139 | A | 11/1998 | Yoshida et al. | |
| 5,966,907 | A | 10/1999 | Julius | |
| 6,343,459 | B1 | 2/2002 | Seaward et al. | |
| 6,428,456 | B1 | 8/2002 | Visona et al. | |
| 6,698,164 | B2 | 3/2004 | Trani et al. | |
| 7,305,805 | B2 | 12/2007 | Dierl et al. | |
| D571,197 | S | 6/2008 | Sanfilippo et al. | |
| 7,553,064 | B2 * | 6/2009 | Johnson et al. | B65B 1/22 366/109 |
| 7,726,103 | B2 | 6/2010 | Chapougnot | |
| 8,015,783 | B2 * | 9/2011 | Iwasa et al. | B65B 9/20 53/201 |
| 8,066,137 | B2 | 11/2011 | Sanfilippo et al. | |
| 8,231,024 | B2 | 7/2012 | Sanfilippo et al. | |
| 8,602,242 | B2 | 12/2013 | Sanfilippo et al. | |
| 8,602,244 | B2 | 12/2013 | Sanfilippo et al. | |
| 2001/0030106 | A1 | 10/2001 | Yamamoto et al. | |
| 2002/0046548 | A1 | 4/2002 | Forman | |
| 2002/0177380 | A1 | 11/2002 | Forman et al. | |
| 2004/0151481 | A1 * | 8/2004 | Cassoli et al. | B29C 65/10 392/379 |
| 2005/0069230 | A1 * | 3/2005 | Takahashi et al. | B65D 75/008 383/104 |
| 2007/0271878 | A1 * | 11/2007 | Hendriks et al. | B65B 9/20 53/451 |
| 2010/0011711 | A1 | 1/2010 | Gehring et al. | |
| 2010/0061665 | A1 | 3/2010 | Inagaki et al. | |
| 2010/0210438 | A1 * | 8/2010 | Nakagawa et al. | B65B 9/2028 493/186 |
| 2011/0131935 | A1 | 6/2011 | Kondo et al. | |
| 2012/0055120 | A1 | 3/2012 | Bierschenik et al. | |
| 2012/0211389 | A9 | 8/2012 | Sanfilippo et al. | |
| 2012/0225763 | A1 | 9/2012 | Shimoda et al. | |
| 2014/0083897 | A1 | 3/2014 | Sanfilippo et al. | |
| 2014/0102936 | A1 | 4/2014 | Sanfilippo et al. | |
| 2014/0109522 | A1 | 4/2014 | Sanfilippo et al. | |
| 2014/0185962 | A1 | 7/2014 | Sanfilippo et al. | |
| 2014/0196406 | A1 | 7/2014 | Sanfilippo et al. | |
| 2014/0283489 | A1 | 9/2014 | Zhu | |

FOREIGN PATENT DOCUMENTS

| | | | | |
|---|---|---|---|---|
| DE | 2901053 | A1 | 7/1980 | |
| DE | 2909479 | A1 | 9/1980 | |
| DE | 3824753 | A1 | 9/1989 | |
| DE | 102005041192 | A1 * | 3/2007 | B65B 51/306 |
| EP | 3029419 | A1 | 5/1981 | |
| EP | 2364838 | A1 | 9/2011 | |
| GB | 1016924 | A | 1/1966 | |
| GB | 1085600 | A | 10/1967 | |
| JP | 06032327 | A * | 2/1994 | |
| JP | 36122406 | A | 5/1994 | |
| JP | 06156451 | A * | 6/1994 | |
| JP | 06183418 | A | 7/1997 | |
| JP | 3224526 | B2 * | 10/2001 | B65B 9/2042 |
| WO | 9534472 | A1 | 12/1995 | |
| WO | 2005118404 | A1 | 12/2005 | |

* cited by examiner

FIG. 2b
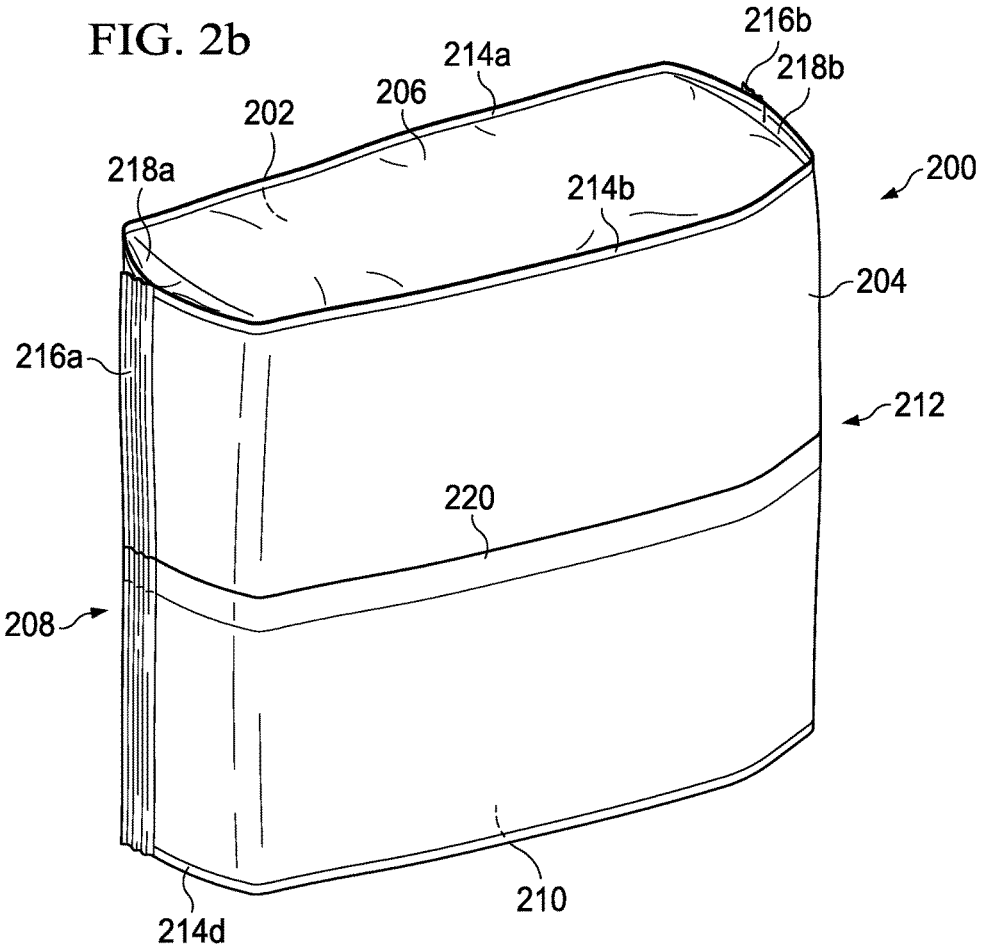
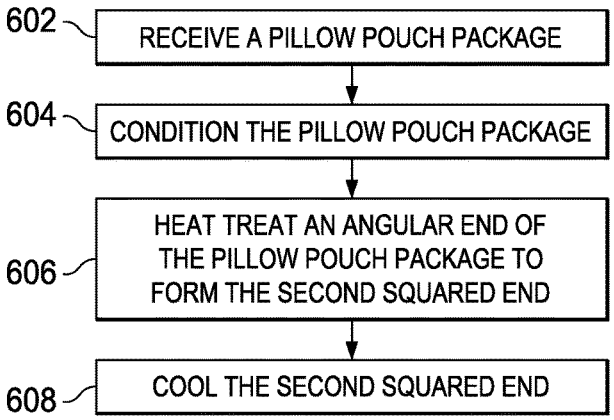
FIG. 6

APPARATUS AND METHOD FOR A STRUCTURALLY RESILIENT PACKAGE

CROSS-REFERENCE TO RELATED APPLICATIONS

This non-provisional application claims priority to, relies on, and has been filed within the twelve months of the filing date of U.S. Provisional Patent Application Ser. No. 62/072,106, filed Oct. 29, 2014, entitled "APPARATUS AND METHOD FOR A STRUCTURALLY RESILIENT PACKAGE," the technical disclosure of which is hereby incorporated by reference in its entirety; U.S. Provisional Patent Application Ser. No. 61/898,593, filed Nov. 1, 2013, entitled "STRUCTURALLY RESILIENT PACKAGE," the technical disclosure of which is hereby incorporated by reference in its entirety and U.S. Provisional Patent Application Ser. No. 61/898,626, filed Nov. 1, 2013, entitled "SYSTEM AND METHOD FOR MAKING A STRUCTURALLY RESILIENT PACKAGE," the technical disclosure of which is hereby incorporated by reference in its entirety.

BACKGROUND OF THE INVENTION

Technical Field

The present invention relates generally to a packaging, and more specifically to improved packaging for food items formed from a plurality of individual pieces.

Description of Related Art

A popular package for storing potato chips and other snack foods is the pillow pouch package. The name of the package is derived from the fact that the shape of the package resembles a pillow. Currently existing pillow pouch packages offer cost effective protection for fragile food items; however, these packages often have obvious drawbacks. For example, certain types of pillow pouch packages are unable to stand upright without additional support. Thus, consumers attempting to retrieve food items from within the package may be required to lean the package against a support that may be in an inconvenient location. Alternatively, the package may be left in a convenient location but leave the consumer without easy access to the opening of the package.

FIG. 1*a* depicts a perspective view of a pillow pouch package according to the prior art. Pillow pouch package 100 is configured with a first substantially squared end 102. Opposite substantially squared end 102 is substantially angular end 104. Although first substantially squared end 102 is not perfectly square, and substantially angular end 104 is not perfectly angular, these ends will be referred to herein as first squared end 102 and angular end 104, respectively, for ease of reference.

FIG. 1*b* depicts a side view of pillow pouch package 100 according to the prior art. Importantly, pillow pouch package 100 depicts squared end 102 and angular end 104 located opposite to squared end 102. The configuration of pillow pouch package 100 allows it to be balanced on squared end 102 and permits access the contents stored within via angular end 104. However, this particular configuration may be prone to tipping over, and as its contents are consumed, the food pieces become harder to reach.

BRIEF SUMMARY OF THE INVENTION

In a first aspect of the invention, a method for making a structurally resilient package having a substantially box-shaped configuration is disclosed. A pillow pouch package is received onto a flighted conveyor. The pillow pouch package has a first squared end and an angular end located opposite to the first squared end. The pillow pouch package is received so that the first squared end rests on the flighted conveyor. Thereafter the pillow pouch package is conditioned at least in part by tamping the angular end with a tamping plate. The angular end of the package is subsequently heat treated to form a second squared end. A set of cooling plates is then applied to the second squared end to set the final shape and form the structurally resilient package having a substantially box-shaped configuration.

In a second aspect of the invention, an apparatus for making a structurally resilient package having a substantially box-shaped configuration is disclosed. The apparatus comprises a flighted conveyor that is configured to receive a pillow pouch package having a first squared end and an angular end located opposite to the squared end. The pillow pouch package is received so that the first squared end rests on the flighted conveyor. In addition, the apparatus further comprises a tamping plate suspended above the flighted conveyor and configured to condition the pillow pouch package. Also suspended above the flighted conveyor and downstream from the tamping plate is a set of heating plates configured to heat treat the angular end of the pillow pouch package to transform the angular end into a second squared end. The apparatus also includes a set of cooling plates suspended above the flighted conveyor and located downstream from the set of heating plates, which is configured to cool the second squared end for setting its shape.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

FIG. 2*b* is an alternate perspective view of a structurally resilient package according to an illustrative embodiment;

FIG. 6 is a flowchart of a process for creating a structurally resilient package in accordance with an illustrative embodiment.

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Embodiments of the present invention recognize that prior art pillow pouch packages may be subject to certain shortcomings, as already discussed above. Accordingly, Applicant has devised an improved pillow pouch package that can be described as a structurally resilient package capable of retaining its box-shaped configuration. Consequently, consumers are provided with an improved eating experience. For example, the structurally resilient package has a relatively wide base compared to its height, yielding increased stability. Further, an optimally placed opening enables consumers to easily access food items without having to reach deeply into a package, which also obviates the need for pouring the contents into a bowl.

Figure 1B:
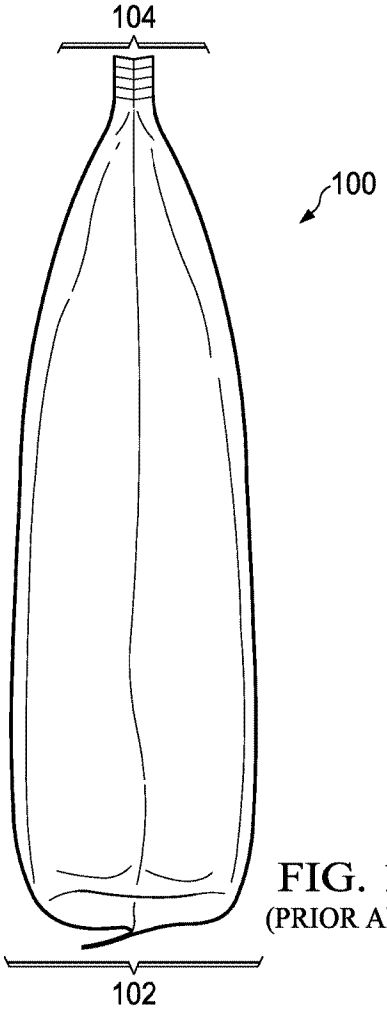
FIG. 1b (PRIOR ART)
FIG. 1*b* is a side view of pillow pouch package according to the prior art.
Figure 1A:
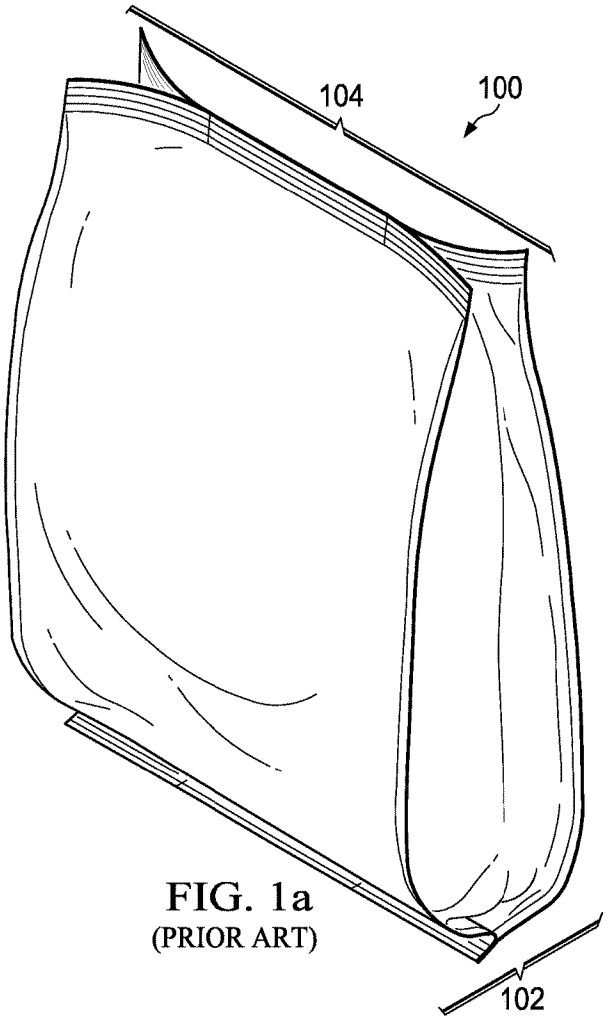
FIG. 1a (PRIOR ART)
FIG. 1*a* is a perspective view of a pillow pouch package according to the prior art.

In an illustrative embodiment, the structurally resilient package disclosed herein is an improved package that is formed from the pillow pouch package shown in FIGS. 1*a* and 1*b*. The prior art packages can be made in accordance with any currently existing or later developed methods. In a non-limiting embodiment, the method can include one or more steps described in the manufacture of "Vertical Stand-Up Pouches" on a vertical form, fill, and seal (VFFS) machine, as described in U.S. Pat. Nos. 7,500,340, 7,197,859, 7,299,608, 7,032,362, 6,860,084, 6,679,034, and 6,722,106, which are hereby incorporated by reference in their entirety.

Figure 2A:
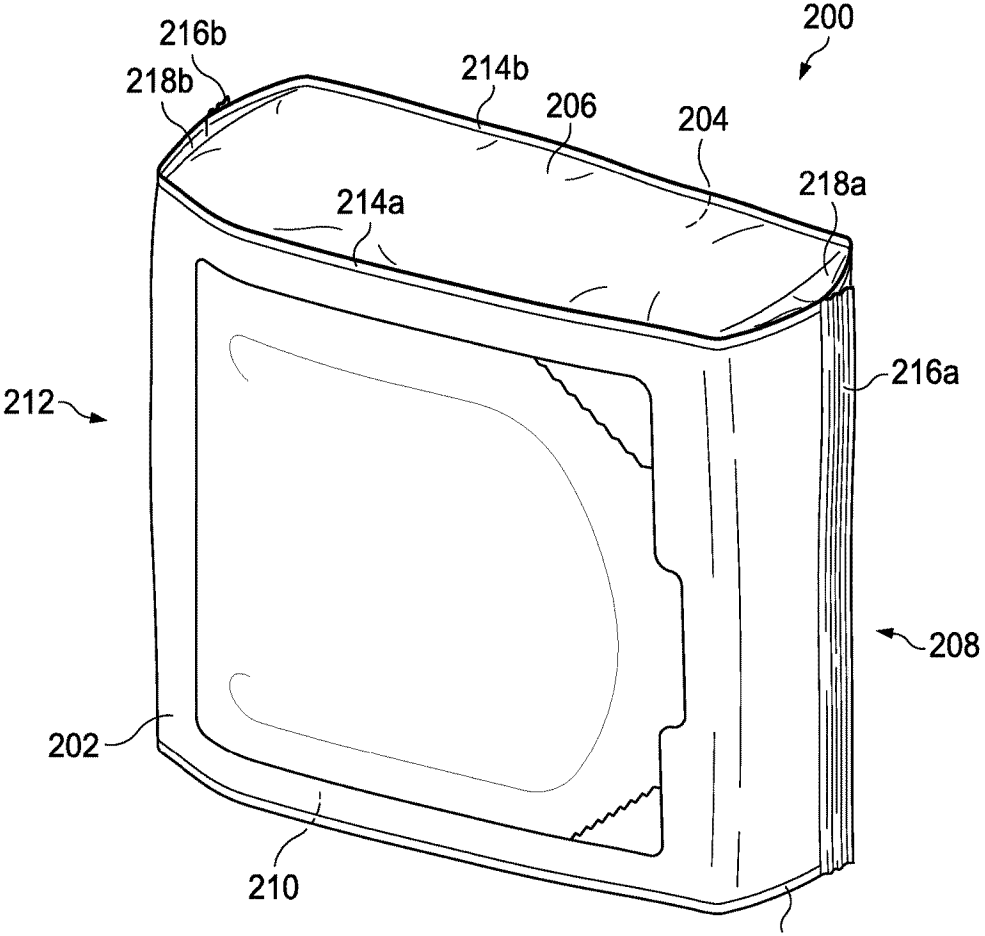
FIG. 2*a* is a perspective view of a structurally resilient package according to an illustrative embodiment.

FIG. 2*a* is a perspective view of a pillow pouch package in accordance with an illustrative embodiment. Pillow pouch package 200, which may also be referred to herein as a structurally resilient package, has a configuration that can generally be described as box-shaped. More specifically, the box shape of pillow pouch package 200 may be described as rectangular; however, in other embodiments, the box shape of pillow pouch package 200 may take the form of a cube. In either event, the front face, back face, and sidewalls of the package may be referred to singularly or collectively as one or more panels, or identified individually by reference numeral. Thus, pillow pouch package 200 can be described as formed from six panels that are joined at approximately 90-degree angles from one another.

Pillow pouch package 200 of FIG. 2*a* includes two parallel faces, front face 202 and back face 204. Additionally, front face 202 is connected to back face 204 by four sidewalls 206, 208, 210, and 212. In this illustrative embodiment, front face 202 and back face 204 are substantially rectangular, however in alternate embodiments, they may be generally in the shape of a square.

Pillow pouch package 200 also includes set of hem seals 214*a-d*, which is a feature that provides increased structural rigidity. A hem seal is a seal located at an edge of one or more panels of pillow pouch package 200. In this illustrative example in FIG. 2*a*, hem seals 214*a* and 214*b* are located approximately around the perimeter of sidewall 206. Opposite and parallel to sidewall 206 is sidewall 210, which is surrounded by set of hem seals 214*c* and 214*d* (shown in FIG. 2*b*). Furthermore, as used herein, the term "set" means one or more. Thus, a set of hem seals is one or more hem seals.

The set of hem seals depicted in pillow pouch package 200 can comprise virtually any shape or thickness. For example, hem seals 214*a-d* are depicted as substantially straight lines; however, in alternate embodiments other shapes and/or patterns may be implemented. Thus, a sinusoidal wave or repeating chevron shape may be used instead. Additionally, the width of the set of hem seals can be adjusted to control the rigidity of pillow pouch package 200. In a non-limiting embodiment the hem seal 106 comprises a width between about 1 mm to about 5 mm.

Sidewall 208 comprises end seal 216*a* that extends down a length of sidewall 208, perpendicular to sidewall 206 and parallel to front face 202. Similarly, sidewall 212, located opposite to sidewall 208, also includes an end seal. Specifically, sidewall 212 includes end seal 216*b*, which is perpendicular to sidewall 206 and parallel to front face 202. End seals 216*a/b* can comprise any end seal known in the art and can be created with any currently existing or later developed device, including sealing jaws. Although the width of the end seals 216*a/b* can vary, one illustrative embodiment includes end seals ranging in thickness between about 0.25 of an inch and about 1 inch.

Pillow pouch package 200 depicted in FIG. 2*a* also includes gussets 218*a* and 218*b*. Gussets are structural portions of a package incorporated in or around a seam to provide expansion or reinforcement. Gussets 218*a/b* are configured with a minimal profile so as to yield a package having characteristically squared panels commonly found in more traditional box-type packages or containers.

With reference to FIG. 2*b*, an alternate perspective view of pillow pouch package 200 is provided which depicts rear face 204. Rear face 204 is a surface of pillow pouch package 200 which would be placed in contact with a resting surface, such as a table, couch, or consumer's lap. Traversing a length of rear face 204 and oriented parallel to sidewalls 206 and 210 is back seal 220. Back seal 220 may comprise any seal known in the art, created using any currently existing or later developed apparatus, including sealing jaws. In this illustrative embodiment in FIG. 2*b*, back seal 220 also continues from rear face 204 a distance into sidewalls 208 and 212 and terminates at end seals 216*a/b*.

Although the illustrative embodiments of FIGS. 2*a* and 2*b* depict only four hem seals, alternate embodiments may include any number of hem seals that may be placed at other locations of pillow pouch package 200. For example, additional hem seals may be incorporated at the approximate intersection of front face 202 and sidewalls 208 and 212. Likewise, hem seals may also be incorporated at the approximate intersection of rear face 206 and sidewalls 208 and 212. The present location of the set of hem seals depicted in pillow pouch package 200 help define the boundaries between the various panels of the package. Although the illustrative embodiments disclosed herein include hem seals, in alternate embodiments pillow pouch package 200 may omit any one or all of the hem seals.

Seals and gussets of pillow pouch package 200 may be formed by an existing vertical form, fill, and seal apparatus. For example, packaging film is unrolled from rolls of wound film and introduced into a vertical form, fill, and seal apparatus. In a non-limiting embodiment, hem seals 214*a-d* are integrated into the film prior to its introduction into the vertical form, fill, and seal machine. Hem seals are created by collecting the film into a desired location and heat-sealing. Once the hem seals are created, the film is wrapped around a former of the vertical form, fill, and seal apparatus. The former is a component of the vertical form, fill, and seal apparatus that enables the film to be manipulated into a vertical tube of film wrapped around a product delivery cylinder. The vertical tube of film achieves the tubular configuration once the edges are vertically sealed along its length, which forms a back seal, such as back seal 220.

The vertical tube of film is then advanced in a downstream direction and a lower transverse seal is formed. Thereafter, food product is deposited into the partially sealed package, and the vertical tube of film is again advanced downstream. An upper transverse seal is then formed on the package, which creates a sealed package. In at least one embodiment, the upper transverse seal of the downstream package is formed concurrently with the lower transverse seal of an upstream package.

Simultaneously with the forming of an upper and a lower transverse seal, a gusset is created adjacent to the upper and lower transverse seals. The gusset can comprise any gusseting mechanism known in the art, including gusseting mechanisms described in U.S. Pat. Nos. 7,500,340, 7,885,574, 8,132,395, and EP Patents EP 23328418 and EP 22186478, the entirety of which are incorporated herein by reference. In one embodiment a continuous motion rotary gusset and sealing jaws are utilized to create the end seals and the gussets, such as end seals 216*a/b* and gussets 218*a/b*. The continuous motion rotary gusset and sealing jaws mechanism moves at a slower vertical speed than the vertical speed at which the film is advanced, causing the film to collect at the location of the gusset mechanism. Substantially concurrently with the formation of the gussets at a location of the upper and lower transverse seals, the package is severed from the upstream package, thus forming a pillow pouch package of the prior art.

Pillow pouch package 200 can be formed from any currently existing or later developed material. In a non-limiting example, the packaging film may be formed from a composite polymer film having multiple layers, and produced by a film converter. The composite polymer film may include a metalized film, such as metalized-oriented polypropylene ("OPP") or metalized-polyethylene terephthalate ("PET"). A sealant layer may be disposed on the interior, product side of the metalized film and may comprise an ethylene-propylene co-polymer and an ethylene-propylene-butene-1 ter-polymer. The sealant layer enables the formation of a hermetic seal by sealing jaws because the melting temperature of the sealant layer is lower than the melting temperature of the metalized film. Accordingly, a hermetic seal can be formed by melting the sealant layer without compromising the integrity of the metalized film.

Adjacent to the metalized film is a laminate layer, such as a polyethylene extrusion, and an outer ink or graphics layer. The ink layer is used for presentation of graphics that can be viewed through a transparent outermost layer, which can comprise OPP or PET. For sake of simplicity and clarity, graphics are not depicted in any of the depicted examples; however, one or more panels of pillow pouch package 200 may comprise graphics.

The various layers introduce barrier properties that protect the contents of pillow pouch package 200 from light, oxygen, and/or moisture. Exposure to these types of elements can result in suboptimal preservation of the contents, which may cause the product to become stale or spoiled, or lose flavor.

Film thickness of pillow pouch package 200 can be adjusted based upon a variety of factors, such as cost and package rigidity. Prior art pillow packages, such as pillow pouch package 100 in FIGS. 1*a* and 1*b*, usually employ thinner films to decrease material costs. However, thinner films provide less rigidity. In contrast, thicker films can be used to form packages having increased rigidity, which allows the packages to maintain a desired shape. Therefore, in a non-limiting embodiment of FIG. 2*a*, pillow pouch package 200 is formed from a film with a thickness between 2-4 mils, which is a thicker film than is typically used in prior art pillow pouch packages.

Figure 3:
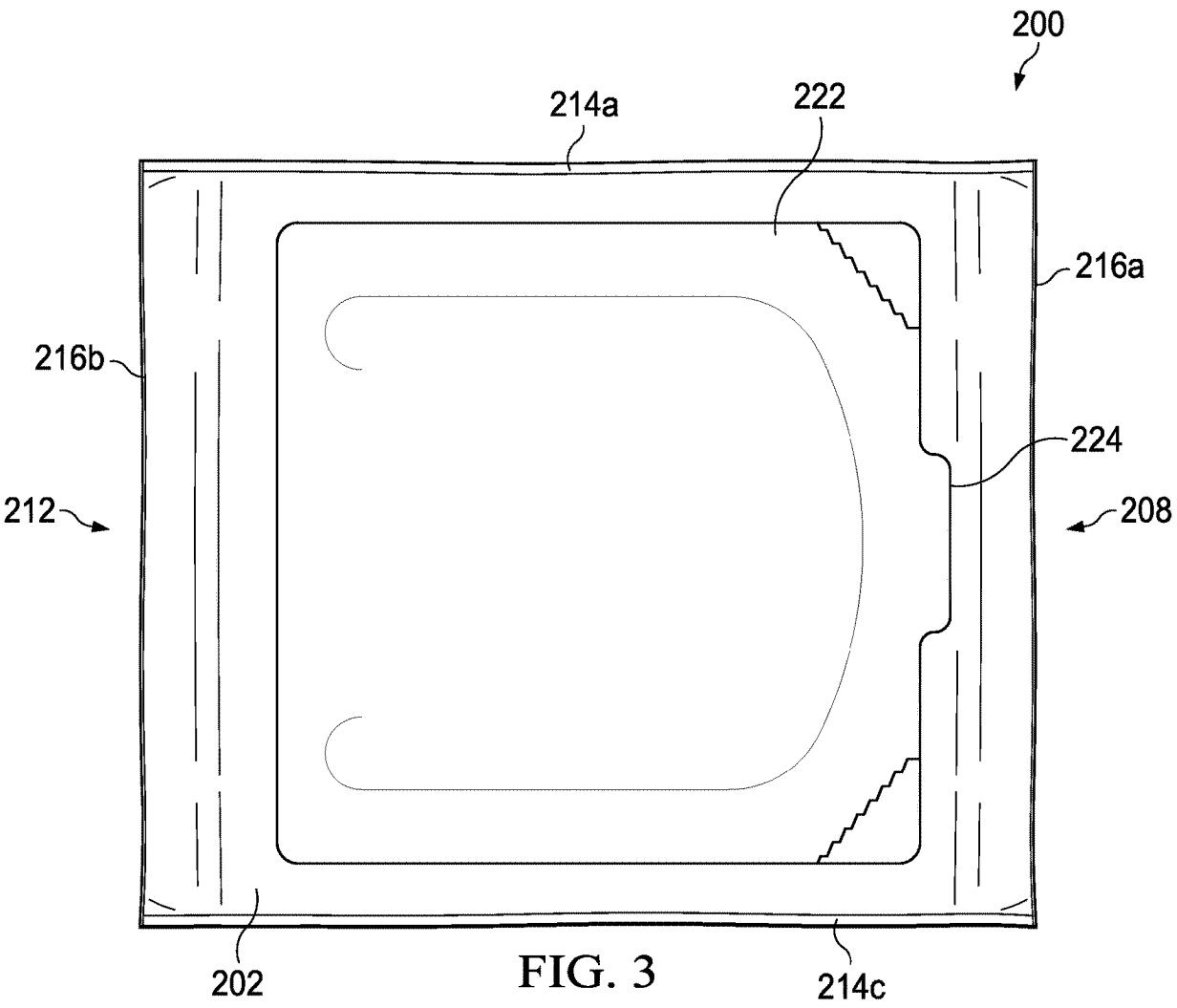
FIG. 3 is a top view of a structurally resilient package according to an illustrative embodiment.

FIG. 3 depicts front face 202 of pillow pouch package 200 in accordance with an illustrative embodiment. Front face 202 includes cover 222 that provides access to the contents stored in pillow pouch package 200. Cover 222 may be configured to be re-sealable using any number of currently existing or later developed methods and technologies. In some non-limiting embodiments, cover 222 may be resealed with adhesives or zippers. As depicted, cover 222 comprises a score line in the outer film layer, and adhesive may be located between the outer film layer of cover 222 and an inner film layer so that a consumer pulling on tab 224 will expose an opening providing access to the contents of the package. Additionally, when cover 222 is replaced over the opening, the adhesive reengages cover 222 to reseal pillow pouch package 200. The adhesive may be located on an underside of cover 222, or alternatively the adhesive may be located on the inner film layer for contacting an underside of cover 222.

Figure 4:
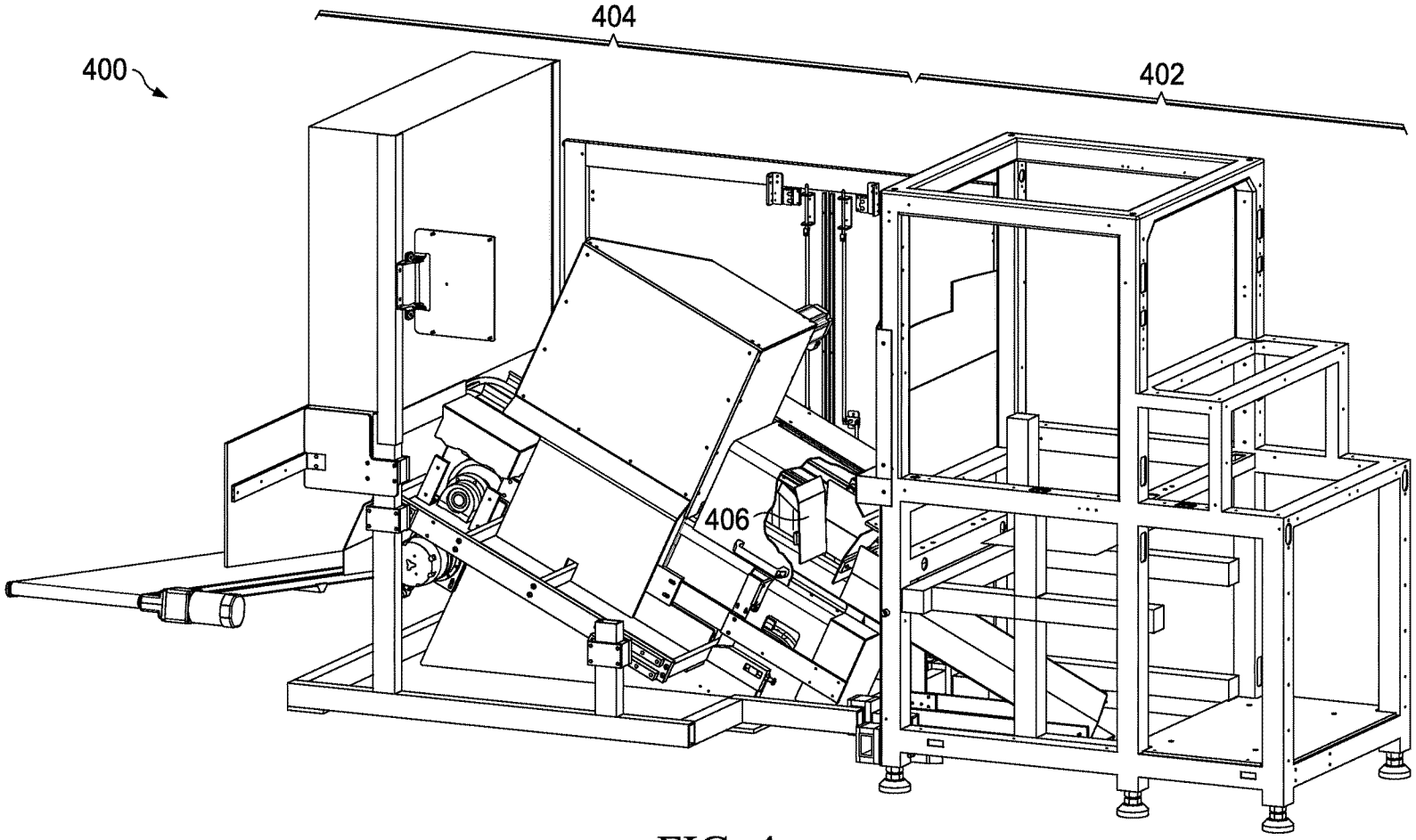
FIG. 4 is a system for forming a structurally resilient package in accordance with an illustrative embodiment.

FIG. 4 is a system for creating a pillow pouch package in accordance with an illustrative embodiment. System 400 includes vertical form, fill, and seal machine 402, which is an apparatus known and used in the art for creating pillow pouch packages, such as pillow pouch package 100. In this example of FIG. 4, vertical form, fill, and seal machine 402 is in communication with shaping apparatus 404, which a system component adapted to transform pillow pouch packages received from vertical form, fill, and seal machine 402 into structurally resilient packages having a box-shaped configuration.

In a non-limiting embodiment, pillow pouch packages are transferred from vertical form, fill, and seal machine 402 to a flighted conveyor of shaping apparatus 404 by receiving bucket 406. In a starting position, receiving bucket 406 is located underneath or within vertical form, fill, and seal machine 402. In an extended position, receiving bucket 406 is located above or within shaping apparatus 404, and more particularly above a flighted conveyor of shaping apparatus 404. Thus, once receiving bucket 406 is provided with a pillow pouch package from vertical form, fill, and seal machine 402, receiving bucket 406 may be transitioned into an extended position for depositing the pillow pouch package onto a flighted conveyor of shaping apparatus 404. In the illustrative example in FIG. 4, receiving bucket 406 is in the extended position, but would return to a starting position underneath vertical form, fill, and seal machine 402 upon delivering a pillow pouch package to shaping apparatus 404.

The pillow pouch package delivered to shaping apparatus 404 has a form that is substantially similar to pillow pouch package 100 in FIGS. 1*a* and 1*b*. Specifically, the pillow pouch package has a squared end 102 and an angular end 104. When the pillow pouch package is deposited onto the flighted conveyor by receiving bucket 406, the squared end is deposited onto a conveying surface of the flighted conveyor. As a result, the angular end of the package projects upward relative to the surface of the flighted conveyor. At a high level, shaping apparatus 404 receives a pillow pouch package of the prior art at a first, receiving end and conveys the pillow pouch package through a series of processing stages to form a structurally resilient package, such as structurally resilient package 200. The structurally resilient package, which has a substantially box-shaped configuration, is ejected from a second end of shaping apparatus 404.

Figure 5:
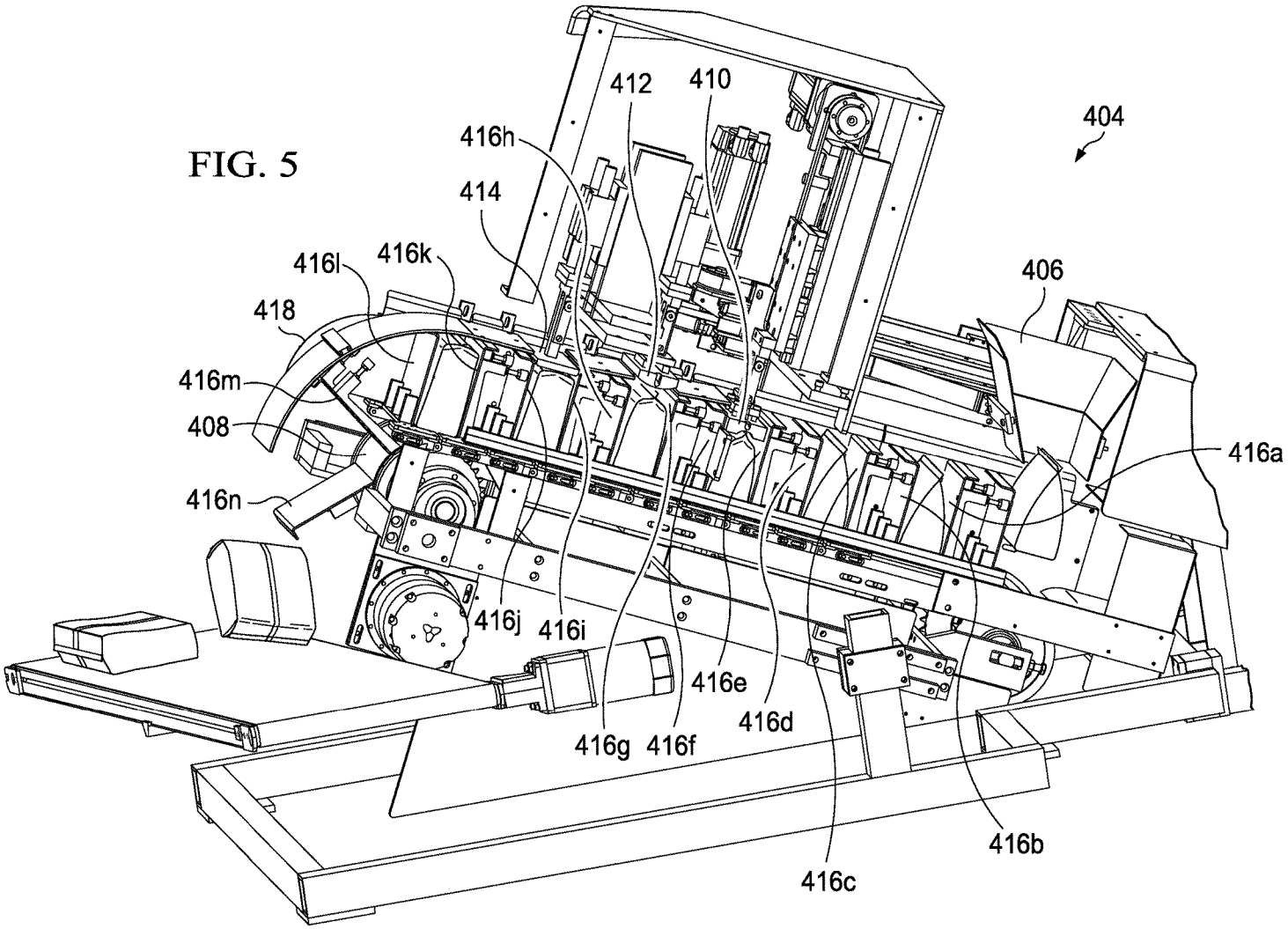
FIG. 5 is a perspective view of an apparatus for forming a structurally resilient package in accordance with an illustrative embodiment.

FIG. 5 is an alternate perspective view of the shaping apparatus in accordance with an illustrative embodiment. Shaping apparatus 404 includes flighted conveyor 408. Flighted conveyor 408 is a conveying apparatus for transporting a package from a first end of shaping apparatus 404 to a second end. The first end of flighted conveyor 408 is located beneath receiving bucket 406, and the second end of the flighted conveyor is located downstream. As used herein, the first end may alternately be referred to as the receiving end and the second end may be referred to as the ejecting end. Between the first and second ends of flighted conveyor 408 are a series of processing plates suspended above flighted conveyor 408. In the illustrative example in FIG. 5, the series of processing plates includes tamping plate 410, set of heating plates 412, and set of cooling plates 414.

Tamping plate 410 is located upstream from set of heating plates 412, which is in turn located upstream from set of cooling plates 414. Generally, tamping plate 410 conditions a package so that heat treatment by set of heating plates 412 will cause the package to deform in a predictable manner. Cooling by set of cooling plates 414 after heat treatment sets the shape of the pillow pouch package so that the substantially box-shaped configuration is maintained.

Each of suspended processing plates has an initial position and an extended position. In the initial position, the processing plates are separated from the pillow pouch packages transported on flighted conveyor 408. In the extended position, each of the suspended processing plates are extended in a direction toward the packages and adapted to engage either an angular end of the package or a second squared end of the package, which is formed from the angular end. In an illustrative embodiment, each of the suspended processing plates is configured to engage an end of pillow pouch package during a processing stage that ranges in time from about 1 second to about 4 seconds. According to this embodiment, a first processing stage may comprise conditioning, a second processing stage may comprise heat treating, and a third processing stage may include cooling.

Tamping plate 410 is adapted to engage and disengage the angular end of a pillow pouch package during the conditioning stage, which applies and removes pressure at the angular end. In a non-limiting embodiment, the process of conditioning also includes rocking the package back and forth while tamping plate 410 engages and disengages the angular end of the package. By applying pressure and removing pressure multiple times while rocking back and forth, the pressure and weight of the package, along with the jostling motion, causes the contents to settle and enables the first squared end of the package to achieve a more characteristically squared shape. In addition, the process of conditioning also prepares the angular end of the pillow pouch package for heat treatment.

In an illustrative embodiment in FIG. 5, tamping plate 410 is configured with a sunken channel that extends a length of its face and is capable of receiving an entirety of an end seal and at least a portion of the angular end of a pillow pouch package. Although a cross-section of the channel is depicted as substantially semi-circular, in alternate embodiments other geometric shapes may be implemented. For example, the cross-section of the channel may be substantially triangular.

Set of heating plates 412 is one or more plates that apply heat treatment to a pillow pouch package. In the illustrative embodiment of FIG. 5, set of heating plates 412 is a single plate that is extendable towards the angular end of the pillow pouch package. During the heat treatment stage, set of heating plates 412 is extended so that the heated surface is in contact with the angular end of the pillow pouch package for the duration of the heat treatment stage. The application of set of heating plates 412 to an angular end of the pillow pouch package transforms the angular end into a second squared end.

Although set of heated plates 412 is depicted in FIG. 5 as a single heated plate that is applied to the angular end of the pillow pouch package, in another embodiment set of heated plates 412 may comprise two or more heated plates. For example, tamping plate 410 may also be heated so that the tamping action is performed with a heated plate that facilitates the conditioning process. In another embodiment, two or more panels of the pillow pouch package may be exposed to heat treatment. For example, in addition to subjecting the angular end to heat treatment, the first squared end resting on a conveying surface of flighted conveyor 408 may also be exposed to heat treatment by a heating plate located proximate to the first squared end, integrated within or beneath the conveying surface of flighted conveyor 408.

The temperature of the set of heated plates can range from about 150° F. to about 250° F.; however, in a more preferred embodiment the temperature of the set of heated plates ranges from 180° F. to about 220° F.

Although the face of the heating plate depicted in FIG. 5 is shown with a slightly convex shape, in other embodiments, other shapes may be utilized. For example, set of heating plates 412 may be flat, or alternatively it may have a shape that is generally concave.

Set of cooling plates 414 is one or more plates for reducing a temperature of the film of a pillow pouch package traveling on flighted conveyor 408. In the illustrative example in FIG. 5, set of cooling plates 414 is depicted as a single cooling plate located downstream from the set of heating plates 412. During the cooling stage, set of cooling plates 414 is extended from its initial position to an extended position so that its cooling surface contacts the second squared end formed by the set of heating plates 412. The temperature of set of cooling plates 414 is maintained at around ambient temperature, which sufficiently lowers the temperature of the packaging film in this processing stage to set the shape of the structurally resilient package.

In a non-limiting embodiment, set of cooling plates 414 is maintained at around ambient temperature by convection. In particular, set of cooling plates 414 is exposed to blowing air by means of an air compressor (not shown) or similar apparatus to facilitate removal of any excess heat that may accumulate as a result of contact with, and heat transfer from, the second end of the pillow pouch package. The residual heat removed from the second end of the pillow pouch package by set of cooling plates 414 was imparted to the package during the previous heat-treatment stage.

In some embodiments, the blowing air is also maintained at or around ambient temperature; however, in alternate embodiments the air may be actively cooled before being blown onto the set of cooling plates 414. For example, a heat transfer apparatus may reduce the temperature of the blowing air before application to set of cooling plates 414. Alternatively, selection of a properly sized nozzle with a sufficiently high flow rate could reduce the temperature of the blowing air in contact with set of cooling plates 414 to facilitate heat transfer.

Set of cooling plates 414 may be continuously or intermittently exposed to blowing air. Furthermore, the blowing air may be directed to any one or more different portions of set of cooling plates 414. For example, an air nozzle may be located above set of cooling plates 414 and directed downward. Alternatively or in addition, an air nozzle may be located beside set of cooling plates 414 and for blowing air horizontally against a side of set of cooling plates 414.

Although set of cooling plates 414 is depicted in FIG. 5 as a single plate, in other embodiments, set of cooling plates 414 may comprise two or more cooling plates located anywhere throughout shaping apparatus 404; however, in a preferred embodiment, other cooling plates would be placed in locations corresponding to the placement of set of heating plates 412. For example, in the embodiment where set of heating plates 412 includes another heated plate located proximate to the first squared end of the pillow pouch package, then set of cooling plates 414 would also have a corresponding cooling plate located proximate to the first squared end of the pillow pouch package, but confined to the cooling stage location along flighted conveyor 408.

In a non-limiting embodiment, each of the three processing stages occurs substantially simultaneously, albeit on different pillow pouch packages. Thus, while tamping plate 410 is applied to a first pillow pouch package, set of heating plates 412 is applied to a second pillow pouch package downstream from the first pillow pouch package. Similarly, set of cooling plates 414 is simultaneously applied to a third pillow pouch package downstream from the first and second pillow pouch packages. In this embodiment, the simultaneous processing of pillow pouch packages at different processing stages also means that the duration of each processing stage is substantially similar.

In another embodiment, flighted conveyor 408 may be configured to advance each package a predetermined distance which corresponds approximately with the distance between the various processing stages within shaping apparatus 404. Furthermore, after advancing each package the predetermined distance, flighted conveyor 408 is adapted to rock each pillow pouch package back and forth so that at least this conditioning step is applied at each processing stage.

As is evident from FIG. 5, flighted conveyor 408 includes a plurality of fins 416*a-n*. The plurality of fins is spaced evenly throughout an entire length of the conveying surface of flighted conveyor 408 and is oriented normally to a conveying surface of flighted conveyor 408. Additionally, the plurality of fins are arranged in pairs that form two sidewalls of a plurality of receiving compartments for receiving pillow pouch packages from receiving bucket 406.

The illustrative example of FIG. 5 depicts six receiving compartments, which correspond with pair of fins 416*a/b*, pair of fins 416*c/d*, pair of fins 416*e/f*, pair of fins 416*g/h*, pair of fins 416*i/j*, and pair of fins 41611. Other receiving compartments are contemplated in this example and would be located on the underside of flighted conveyor 408, but are obscured. The conveying surface of flighted conveyor 408 forms a third sidewall of each of the plurality of receiving compartments. The fourth and fifth sidewalls of each of the plurality of receiving compartments are formed from a pair of extended sidewalls parallel to one another, both of which extend a length of flighted conveyor 408, and are oriented perpendicular to each of the plurality of fins. For example, extended sidewall 418 forms the fourth sidewall of each of the plurality of receiving compartments. The second extended sidewall has been removed for sake of clarity so that the inner working components of flighted conveyor 408 could be shown.

Accordingly, a receiving compartment encloses a pillow pouch package deposited therein on five sides, leaving one exposed panel on the package. In one embodiment, the dimensions of each receiving compartment correspond to the desired shape of the structurally resilient package of the present invention.

The opening at one end of each receiving compartments enables the pillow pouch package to be deposited onto flighted conveyor 408, ejected from flighted conveyor 408 after processing, and also allows the pillow pouch package to be engaged by the series of suspended processing plates located above. For example, a pillow pouch package located between pair of fins 416*g/h* is enclosed on five sides by the sidewalls of a receiving compartment, and the exposed panel of the package can be engaged by set of heating plates 412. In another embodiment, various other panels of the pillow pouch package may also be heat treated by one or more other heating plates even though those panels are still in contact with a sidewall of a receiving compartment.

When a pair of fins reach an end of flighted conveyor 408 opposite from receiving bucket 406, the pair of fins separate, expanding the corresponding receiving compartment and ejecting a structurally resilient package from shaping apparatus 404. For example, pair of fins 416*m/n* have reached an end of flighted conveyor 408, and as the pair of fins transitions from the upper side of the conveyor to the underside of the conveyor, the package contained within the receiving compartment is ejected as the receiving compartment is expanded. A similar phenomenon occurs with pairs of fins on the receiving end of flighted conveyor 408. For example, as a pair of fins transitions from the underside of flighted conveyor 408 to the upper side, the pair of fins separates, facilitating the deposit of a pillow pouch package into the receiving compartment. As the fins progress away from the receiving end of flighted conveyor 408, the pair of fins comes together to reform a receiving compartment that securely encompasses the pillow pouch package.

FIG. 6 is a flowchart of a process for creating a structurally resilient package in accordance with an illustrative embodiment. The steps of flowchart 600 may be implemented by a shaping apparatus, such as shaping apparatus 404 in FIGS. 4 and 5.

The process begins by receiving a pillow pouch package (step 602). The pillow pouch package may be received from a vertical form, fill, and seal apparatus that is known and used in the art. The pillow pouch package received at step 602 generally has the shape and configuration of prior art pillow pouch package 100 with a first squared end and an angular end located opposite from the squared end. The pillow pouch package is received into a receiving compartment of a flighted conveyor, such as flighted conveyor 408 depicted in FIG. 5. More specifically, the pillow pouch package is received so that the first squared end is resting on the conveying surface of the flighted conveyor and the angular end is exposed at the top of the receiving compartment.

After the pillow pouch package has been received, it is conditioned (step 604). In a first embodiment, conditioning the package comprises rocking the pillow pouch package back and forth. The pillow pouch package may be rocked continuously as it is being conveyed along a length of the flighted conveyor, or alternatively the package may be rocked at periodic intervals on the flighted conveyor that correspond to the various processing stages of the shaping apparatus. In another illustrative embodiment, conditioning the package comprises applying a tamping force onto an angular end of the pillow pouch package by a tamping plate, such as tamping plate 410. In yet another embodiment, conditioning the pillow pouch package may comprise both rocking the package and also applying a tamping force to the angular end of the pillow pouch package. The tamping force is applied by a tamping plate that repeatedly engages and disengages the package. The conditioning step prepares the pillow pouch package for subsequent transformation by settling the product and pre-forming the film so that addition of heat causes the film to deform in an expected manner.

The pillow pouch package is then heat-treated to transform the angular end of the pillow pouch package into a second squared end (step 606). The heat treatment may be accomplished by applying a set of heated plates to the angular end of the package. The set of heated plates may include a single heated plate, or two or more heated plates. For example, the set of heated plates may be a heated plate, such as set of heating plates 412 in FIG. 5, or in another exemplary embodiment the tamping plate may also be adapted to include a heating element so that the tamping of the pillow pouch package also serves to initially heat treat the film. Additional heated plates may be located in various locations of the shaping apparatus. For example, heating elements may be incorporated beneath the flighted conveyor, or on the plurality of fins of the flighted conveyor.

After heat treatment, the pillow pouch packaged is cooled (step 608). Cooling the pillow pouch package causes the film to set in the shape that was created in the previous step 606. The pillow pouch package may be cooled by applying a set of cooling plates to one or more panels of the package. In an illustrative embodiment, the set of cooling plates is a single cooling plate, such as set of cooling plates 414 in FIG. 5, which is located above the flighted conveyor and configured to engage the second squared end of pillow pouch package. In alternate embodiments, additional cooling plates may be located in various other locations of the flighted conveyor which cool portions of the pillow pouch package that was previously exposed to heat treatment in the step 606.

The flowchart in the figure provided above illustrates a method for creating a pillow pouch package having a substantially box-shaped form. Each block in the flowchart may represent a step in an overall process. In some alternative implementations, the steps in the various blocks may occur out of order provided in the figures. For example, two blocks in the flowchart that are shown in success may actually be implemented substantially concurrently. Alternatively, the steps depicted in two successive blocks may actually be executed in reverse order, depending upon the particular implementation.

According to the apparatus and method disclosed herein, a structurally resilient package has been disclosed which has certain beneficial characteristics over the prior art pillow pouch packages. The beneficial characteristics can be attributed to the box-shaped configuration that utilizes an increased package thickness and structural components, such as hem seals. These structurally resilient packages have a broader base that provides increased stability, and an optimally placed opening for ease of access to contents stored therein.

Moreover, the apparatus devised by the Applicant for creating the structurally resilient package is adapted to receive and manipulate packages formed by currently existing equipment, such as a vertical form, fill, and seal apparatus known and used in the art. As a result, the Applicant's packages can be made with minimal modification to existing equipment and a lower initial investment.

While the invention has been particularly shown and described with reference to preferred embodiment, it will be understood by those skilled in the art that various changes in form and detail may be made therein without departing from the spirit and scope of the invention.

Additional Disclosure

In a first aspect, an embodiment of the invention is a method for creating a structurally resilient package having a substantially box-shaped configuration. A pillow pouch package is received onto a flighted conveyor. The pillow pouch package has a first squared end and an angular end located opposite to the first squared end. The pillow pouch package is received so that the first squared end rests on the flighted conveyor. The pillow pouch package is conditioned, at least in part, by tamping the angular end with a tamping plate. Then the angular end of the package is heat treated to form a second squared end. The second squared end is cooled to set the final shape and form the structurally resilient package having a substantially box-shaped configuration.

Another embodiment including any one or more elements of a previous embodiment disclosed above wherein the pillow pouch package is received from a vertical form, fill, and seal machine into one of a plurality of receiving compartments formed at least partially from a pairs of fins oriented perpendicularly to a surface of the flighted conveyor.

Another embodiment including any one or more elements of a previous embodiment disclosed above wherein the conditioning step further includes rocking the pillow pouch package in a front to back motion relative to the direction of travel on the flighted conveyor.

Another embodiment including any one or more elements of a previous embodiment disclosed above wherein the heat treating step further comprises applying a set of heating plates to the angular end of the pillow pouch package to form the second squared end.

Another embodiment including any one or more elements of a previous embodiment disclosed above wherein the set of heating plates is applied continuously to the angular end of the pillow pouch package.

Another embodiment including any one or more elements of a previous embodiment disclosed above wherein the set of heating plates is applied by repeatedly engaging and disengaging the angular end of the pillow pouch package.

Another embodiment including any one or more elements of a previous embodiment disclosed above wherein the cooling step further comprises applying a set of cooling plates to the second squared end.

Another embodiment including any one or more elements of a previous embodiment disclosed above further including the steps of advancing the pillow pouch package to an initial processing stage, rocking the pillow pouch in a front to back motion relative to the direction of travel on the flighted conveyor, and advancing the pillow pouch package to a subsequent processing stage.

Another embodiment including any one or more elements of a previous embodiment disclosed above further including the step of tamping the angular end by repeatedly engaging and disengaging the angular end of the pillow pouch package with the tamping plate.

Another embodiment including any one or more elements of a previous embodiment disclosed above further including the step of blowing air at the set of cooling plates.

In a second aspect, an embodiment of the invention is an apparatus for creating a structurally resilient package having a substantially box-shaped configuration. The apparatus includes a flighted conveyor configured to receive a pillow pouch package having a first squared end and an angular end located opposite to the squared end, and wherein the pillow pouch package is received so that the first squared end rests on the flighted conveyor. In addition, the apparatus includes a tamping plate suspended above the flighted conveyor, which is configured to condition the pillow pouch package. The apparatus also includes a set of heating plates suspended above the flighted conveyor and downstream from the tamping plate, wherein the set of heating plates are configured to heat treat the angular end to transform the angular end into a second squared end. Downstream from the set of heating plates is a set of cooling plates suspended above the flighted conveyor, wherein the set of cooling plates are configured to cool the second squared end of pillow pouch package.

Another embodiment including any one or more elements of a previous embodiment disclosed above wherein the apparatus also includes a vertical form, fill, and seal apparatus in communication with the shaping apparatus.

Another embodiment including any one or more elements of a previous embodiment disclosed above wherein the apparatus also includes a receiving bucket that receives the pillow pouch package from a vertical form, fill, and seal machine and deposits the pillow pouch package onto the flighted conveyor.

Another embodiment including any one or more elements of a previous embodiment disclosed above wherein the apparatus includes a plurality of fins projecting perpendicularly from a surface of the flighted conveyor.

Another embodiment including any one or more elements of a previous embodiment disclosed above wherein the plurality of fins are arranged in pairs.

Another embodiment including any one or more elements of a previous embodiment disclosed above wherein each pair of fins form opposing walls of a receiving compartment.

Another embodiment including any one or more elements of a previous embodiment disclosed above further comprising a first sidewall located adjacent to a first side of the flighted conveyor, and a second sidewall located adjacent to a second side of the flighted conveyor. The first sidewall and the second sidewall are parallel to each other and span a length of the flighted conveyor.

Another embodiment including any one or more elements of a previous embodiment disclosed above wherein the flighted conveyor is inclined relative to a supporting surface of the apparatus.

Another embodiment including any one or more elements of a previous embodiment disclosed above wherein the tamping plate further comprises a first surface adapted to engage the angular end of the pillow pouch package, and wherein the first surface comprises a channel adapted to receive an end seal located at the angular end.

Another embodiment including any one or more elements of a previous embodiment disclosed above wherein the channel is configured with a cross-section that is substantially semi-circular.

We claim:

1. A method for making a structurally resilient package, the method comprising:

receiving a pillow pouch package onto a flighted conveyor, wherein the pillow pouch package has a first squared end and an angular end located opposite to the first squared end, and wherein the pillow pouch package is received so that the first squared end rests on the flighted conveyor;

conditioning the pillow pouch package to form a conditioned pillow pouch package, wherein conditioning further comprises tamping the angular end with a tamping plate;

heat treating the angular end of the conditioned pillow pouch package to transform the angular end to a second squared end; and cooling the second squared end.

2. The method of claim 1, wherein the receiving step further comprises:

receiving the pillow pouch package from a vertical form, fill, and seal machine, wherein the pillow pouch package is received into one of a plurality of receiving compartments formed at least partially from a pair of fins oriented perpendicularly to a surface of the flighted conveyor.

3. The method of claim 1, wherein the conditioning step further comprises:

rocking the pillow pouch package in a front to back motion relative to the direction of travel on the flighted conveyor.

4. The method of claim 1, wherein the heat treating step further comprises:

applying a set of heating plates to the angular end of the conditioned pillow pouch package to form the second squared end.

5. The method of claim 4, wherein the set of heating plates is applied continuously to the angular end of the conditioned pillow pouch package.

6. The method of claim 4, wherein the set of heating plates is applied by repeatedly engaging and disengaging the angular end of the conditioned pillow pouch package.

7. The method of claim 1, wherein the cooling step further comprises:

applying a set of cooling plates to the second squared end.

8. The method of claim 7, further comprising:

blowing air at the set of cooling plates.

9. The method of claim 1, wherein each step of the method is performed at a discrete processing stage, and wherein the method further comprises:

advancing the pillow pouch package to an initial processing stage;

rocking the pillow pouch in a front to back motion relative to the direction of travel on the flighted conveyor; and advancing the pillow pouch package to a subsequent processing stage.

10. The method of claim 1, wherein tamping the angular end of the pillow pouch package further comprises:

repeatedly engaging and disengaging the angular end of the pillow pouch package with the tamping plate.

11. The method of claim 1, further comprising:

forming the pillow pouch, wherein the pillow pouch has a first gusset adjacent to an upper transverse seal and a second gusset adjacent to a lower transverse seal.

12. An apparatus for forming structurally resilient package, the system comprising:

a flighted conveyor, wherein the flighted conveyor is configured to receive a pillow pouch package having a first squared end and an angular end located opposite to the squared end, and wherein the pillow pouch package is received so that the first squared end rests on the flighted conveyor;

a tamping plate suspended above the flighted conveyor, wherein the tamping plate is configured to condition the pillow pouch package;

a set of heating plates suspended above the flighted conveyor and downstream from the tamping plate, wherein the set of heating plates are configured to engage the angular end to transform the angular end into a second squared end; and a set of cooling plates suspended above the flighted conveyor and located downstream from the set of heating plates, wherein the set of cooling plates are configured to engage the second squared end of pillow pouch package.

13. The apparatus of claim 12, further comprising:

a vertical form, fill, and seal apparatus in communication with the shaping apparatus.

14. The apparatus of claim 13, wherein the vertical form, fill, and seal machine further comprises:

a gusseting mechanism to form a first gusset adjacent to an upper transverse seal of the structurally resilient package and a second gusset adjacent to a lower transverse seal of the structurally resilient package.

15. The apparatus of claim 12, further comprising:

a receiving bucket, wherein the receiving bucket receives the pillow pouch package from a vertical form, fill, and seal machine and deposits the pillow pouch package onto the flighted conveyor.

16. The apparatus of claim 12, further comprising:

a plurality of fins projecting perpendicularly from a surface of the flighted conveyor.

17. The apparatus of claim 16, wherein the plurality of fins are arranged in pairs.

18. The apparatus of claim 17, wherein each pair of fins form opposing walls of a receiving compartment.

19. The apparatus of claim 12, further comprising:

a first sidewall located adjacent to a first side of the flighted conveyor;

a second sidewall located adjacent to a second side of the flighted conveyor; and wherein the first sidewall and the second sidewall are parallel to each other, and wherein the first sidewall and the second sidewall span the length of the flighted conveyor.

20. The apparatus of claim 12, wherein the flighted conveyor is inclined relative to a supporting surface of the apparatus.

21. The apparatus of claim 12, wherein the tamping plate further comprises a first surface positioned to engage the angular end of the pillow pouch package, and wherein the first surface comprises a channel oriented to receive an end seal located at the angular end.

22. The apparatus of claim 21, wherein the channel is configured with a cross-section that is substantially semi-circular.

* * * * *